US005265797A

United States Patent [19]

Velge et al.

[11] Patent Number: 5,265,797

[45] Date of Patent: Nov. 30, 1993

[54] BOX CONSTRUCTION

[75] Inventors: Gordon O. Velge, Swarthmore, Pa.; Clifford L. Stafford, Woodbury, N.J.

[73] Assignee: Teledyne Industries, Inc., Chester, Pa.

[21] Appl. No.: 885,716

[22] Filed: May 18, 1992

[51] Int. Cl.[5] ..... B65D 43/14

[52] U.S. Cl. ..... 229/125.26; 229/915

[58] Field of Search ..... 229/125.26, 125.27, 229/23 R, 23 BT, 915, DIG. 11; 206/515; 220/306, 355

[56] References Cited

U.S. PATENT DOCUMENTS

| | | | |
|---|---|---|---|
| 1,993,216 | 3/1935 | Marshall . | |
| 2,317,884 | 4/1943 | Clouston | 206/44 |
| 2,762,551 | 9/1956 | Fallert | 229/23 |
| 2,902,202 | 9/1959 | Fallert | 229/23 R |
| 2,990,998 | 7/1961 | Barclay | 220/355 |
| 3,021,044 | 2/1962 | Schubert . | |
| 3,363,823 | 1/1968 | Paige et al. . | |
| 3,562,999 | 2/1971 | Barbedienne | 53/30 |
| 3,596,781 | 8/1971 | Burton | 214/10.5 |
| 3,632,016 | 1/1972 | Bozek | 220/355 |
| 3,999,677 | 12/1976 | Oberkircher | 220/355 |
| 4,019,634 | 4/1977 | Bonnot | 229/23 R |
| 4,042,169 | 8/1977 | Burgdorf | 229/125.26 |
| 4,192,434 | 3/1980 | Conroy | 220/306 |
| 4,265,184 | 5/1981 | Cox | 108/55.1 |
| 4,292,901 | 10/1981 | Cox | 108/55.1 |
| 4,305,524 | 12/1981 | McLaren et al. | 229/125.26 |
| 4,762,226 | 8/1988 | Gatton | 206/320 |
| 4,774,063 | 9/1988 | Runnells | 422/297 |
| 4,811,860 | 3/1989 | Sorenson et al. | 206/515 |
| 4,877,137 | 10/1989 | Govang et al. | 206/597 |
| 4,892,247 | 1/1990 | Dirksing et al. | 220/355 |
| 4,995,513 | 2/1991 | Rösler | 206/446 |
| 5,005,759 | 4/1991 | Bouche | 229/125.26 |

*Primary Examiner*—Gary E. Elkins
*Attorney, Agent, or Firm*—Eugene Chovanes

[57] ABSTRACT

A box for storing and shipping empty collapsible tubes in upright honeycombed column form, having a body of continuous sides and ends, having a lip at the top and bottom that engages snaps in a groove on top and bottom lids. When disassembled, the box body can be folded flat and the lids nested.

6 Claims, 3 Drawing Sheets

Fig. 8.
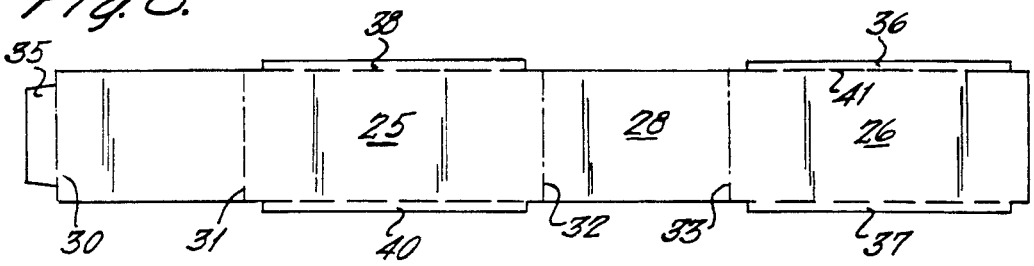
Fig. 9.
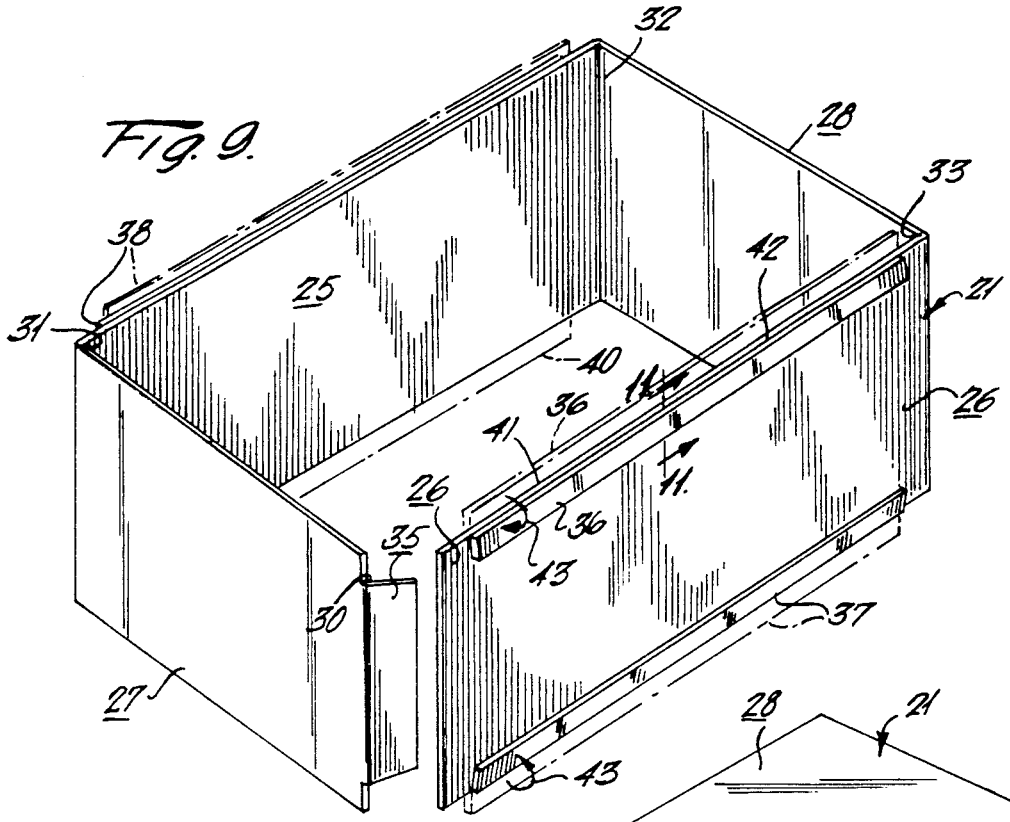
Fig. 10.
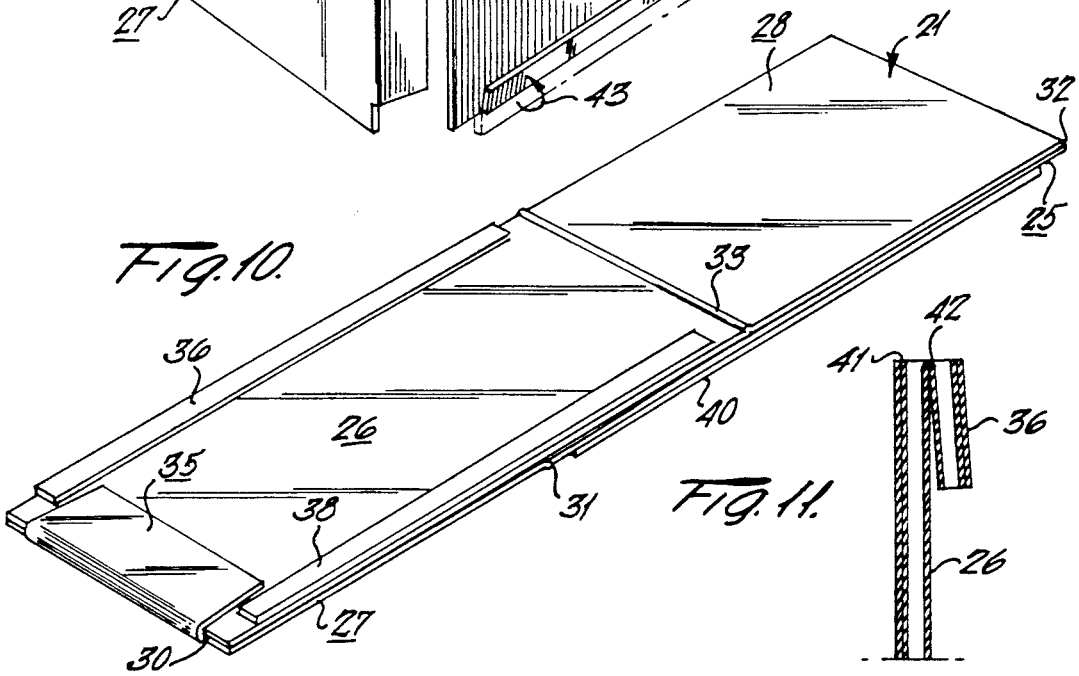
Fig. 11.

BOX CONSTRUCTION

BACKGROUND OF THE INVENTION

1. Field of the Invention

The present invention relates generally to a packaging container, and specifically to an easily erected rectangular box having collapsible continuous sidewalls and separate bottom and top molded covers that snap into the expanded sidewalls. The box is used for shipping empty collapsible tubes from the tube manufacturer to the product maker who fills and seals the tubes.

2. Description of Related Art

Empty collapsible tubes are produced by a tube manufacturer and then shipped to a product maker for filling with, for instance, pharmaceuticals, artists' colors, or toothpaste, and then sealed.

The empty tubes are fragile and easily deformed; hence, they are carefully packaged in boxes, either partitioned or unpartitioned, for shipment.

In a partitioned box, partitions extend at right angles to one another, in grid fashion, to form individual cubicles, slightly larger than the tube cross section area to receive a tube vertically in a box.

In an unpartitioned box, the tubes extend upright, one against another, to form in effect a plurality of columns that occupy the entire box. The tubes combine to reinforce one another to provide vertical resistance against a box top which may rest thereon. The tubes lie against one another throughout their length and, since they are relatively light in weight in an unfilled condition, dents in or crushing of the sidewall is prevented.

The boxes are purchased by the tube manufacturers from box makers. Such boxes are shipped in knocked-down condition so they occupy less costly shipping space. Nested preconstructed boxes cannot be used, since nested boxes require tapering. By the very nature of the tube arrangement in the box, vertical sidewalls are necessary. The boxes are erected by the tube manufacturer by making the necessary movements and connections in the boxes.

It is important that the tubes remain clean, particularly where they are to be filled with pharmaceuticals. Nevertheless, in some instances, particularly when the boxes are of a chipboard construction, fibers separate from the boxes and undesirably get into the boxes. Also, the boxes, particularly the chipboard boxes, often are quite flexible and not very rigid. This creates excess space problems as the box walls "waffle" or, in the alternative, the tubes themselves are damaged by crushing since the walls do not offer resistance.

Additionally, a great inventory of box sizes must be kept in that the various length tubes all require different height boxes. Also, numerous different lengths and widths must be kept in inventory.

The boxes are generally of opaque construction, so that once the box is closed, one can no longer inspect the contents.

SUMMARY OF THE PRESENT INVENTION

The box of the invention, in assembled form, is used with or without partitions, as in the prior art, to contain and support vertically extending empty collapsible tubes. The box height is equal to the height of the tubes.

The box sidewalls are continuous and are separate from the box top and bottom, which are identical. The sidewalls collapse when in unassembled form, so that a side and end lie in abutting relationship to an opposing side and end. The sidewalls are formed of a relatively rigid material such as corrugated cardboard, or corrugated plastic.

In erecting the box, the flattened four sides are simply rotated, one to another, to get a rectangular arrangement. A preformed member, or cover, is then snapped over the lower opening to form the box bottom and, after the box is filled, another identical member is snapped over the open top of the box. The sides of the box have an upper and lower lip on opposing sides, or optionally on all four sides. The lip forms a snap fit and a snap connection with the flat top and bottom which is formed of a molded plastic such as, for instance, a PET plastic which is formed from recycled plastic. The cover is suitably ridged to provide rigidity and is suitably transparent which permits easy inspection and observation through the box without removing the cover.

When the box of this invention is used in accordance with the teaching in U.S. Pat. No. 5,138,822, only two size covers are necessary for virtually all standard sizes of collapsible tubes; namely, a size for a 16"×10¾" box, and a cover for a size 16"×10" box. These covers are adapted to nest, one on top of another, prior to assembly into a box, so that only two stacks of covers are necessary.

The assembled boxes are such that they are permissibly stackable, one on top of another, with suitable detents which prevent shifting. Additionally, there are box-nest patterns when the boxes are placed on a shipping skid, wherein the boxes are arranged in a specific position in a horizontal row, again as shown in U.S. Pat. No. 5,138,822.

The covers are returnable and can be permissibly sterilized or cleaned and reused in an assembled box. If used as disclosed in the '285 application where only two sizes are used, reuse of the covers would be an easy matter, in that the returned covers could be readily separated into two different sizes. The collapsed sides could also possibly be returned if they are of plastic or more durable product.

Where the sides, as well as the top and bottom, are made of a plastic, the entire package would lend itself to sterilization by the filler customer without removing the tubes from the package, for instance with a loading cartridge as in the prior art, saving effort and expense. Sterilization could be by gas. Although the cover could be removed during gas sterilization to expose the tubes to the gas, suitable openings could be formed in the box to provide access without removing the cover. For instance, punch-out tabs could be preformed into the covers.

In the invention, the clean vertical sidewalls of the box are substantially supported at all sides by stiff top and bottom members that are snapped into place. There is no on-site gluing necessary in the invention as set forth, nor is there a need for taping or the like since the snap arrangement eliminates such need. By providing a fold-down lip on the sides as discussed above, there is an element of reinforcement provided by the sidewalls themselves against bending of the walls which is undesirable with respect to the relatively fragile inner contents, the empty collapsible tubes.

The box can readily utilize the strength of the tubes in a column effect, whereby substantial resistance is exerted against outside vertical crushing forces, so that substantial stacking of the boxes can take place. By making the sidewalls somewhat shorter in height, and providing some depth to the cover members, the box can be so constituted that the covers themselves now have sides which cooperate with the sidewall of the box to snap together to apply pressure onto the open end of the tubes, in the manner of a compressed accordian. Such an arrangement puts the tubes in slight compression vertically, so that the full, pre-stressed column effect is obtained.

By using a fully removable cover, which exposes the open circular bottoms of the inverted empty tubes, the tubes can be introduced and positioned within the tube filling machines, without interferences from the cover.

BRIEF DESCRIPTION OF THE DRAWINGS

FIG. 8 is a plan view of a sidewall blank, showing the various crease and slit lines.

FIG. 9 is an isometric view showing the blank being erected into the desired sidewall configuration.

FIG. 10 is a perspective view of the erected sidewall in a flattened mode for stacking.

FIG. 11 is an enlarged fragmentary sectional view taken on the line 11,11 of FIG. 9, showing details of the folded-down lip incorporated on the upper and lower terminal ends of two parallel spaced-apart sidewalls.

DETAILED DESCRIPTION OF THE PREFERRED EMBODIMENT

Figure 1:
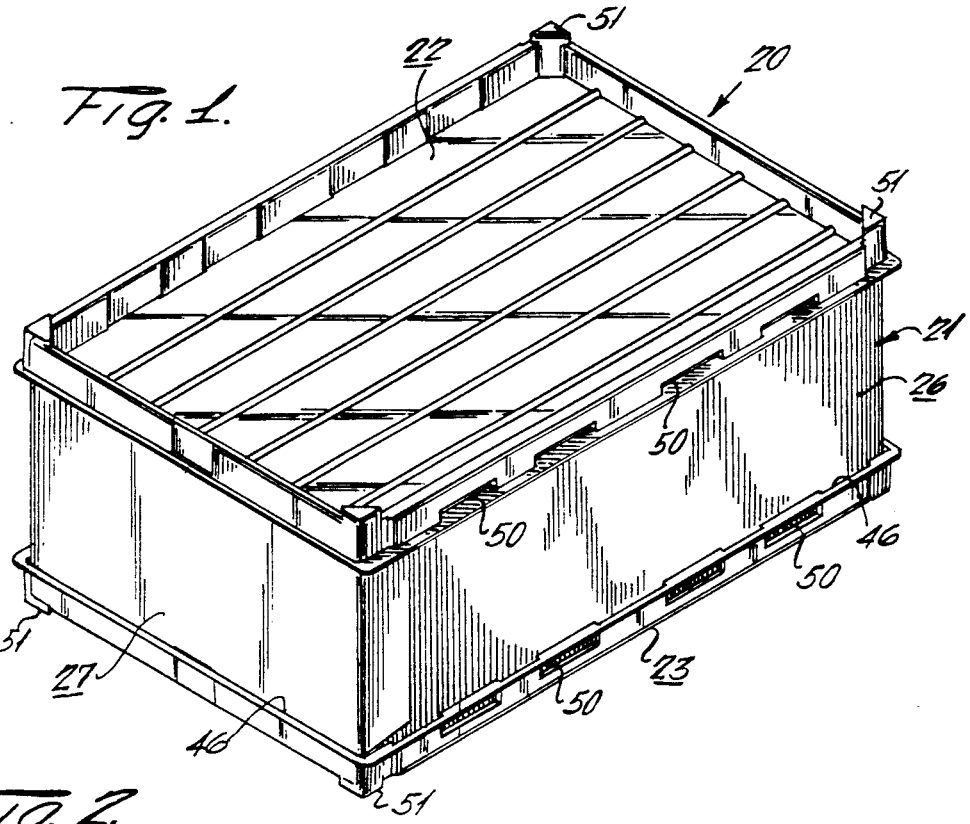
FIG. 1 is an isometric view of a shipping box designed for the express purpose of transporting fragile empty collapsible metal tubes, all in accordance with the invention.

Box 20 has a body 21, top 22, and bottom 23. Body 21 has opposing longitudinal sides 25 and 26, and ends 27 and 28. Body 21 is formed of a relatively rigid material such as corrugated cardboard or corrugated plastic. The corrugated material is, for instance, of a B-flute of a 200 lb. test strength. The dimensions of the box, where it is used for packing and shipping empty collapsible tubes as set forth in my copending application ('285) referred to above, would be 16" long and 10" or 10¾" wide, although the construction is not limited to any specific size. The box height is determined, in boxes having the dimensions set forth above, by the height of the collapsible tubes being shipped.

Figure 4:
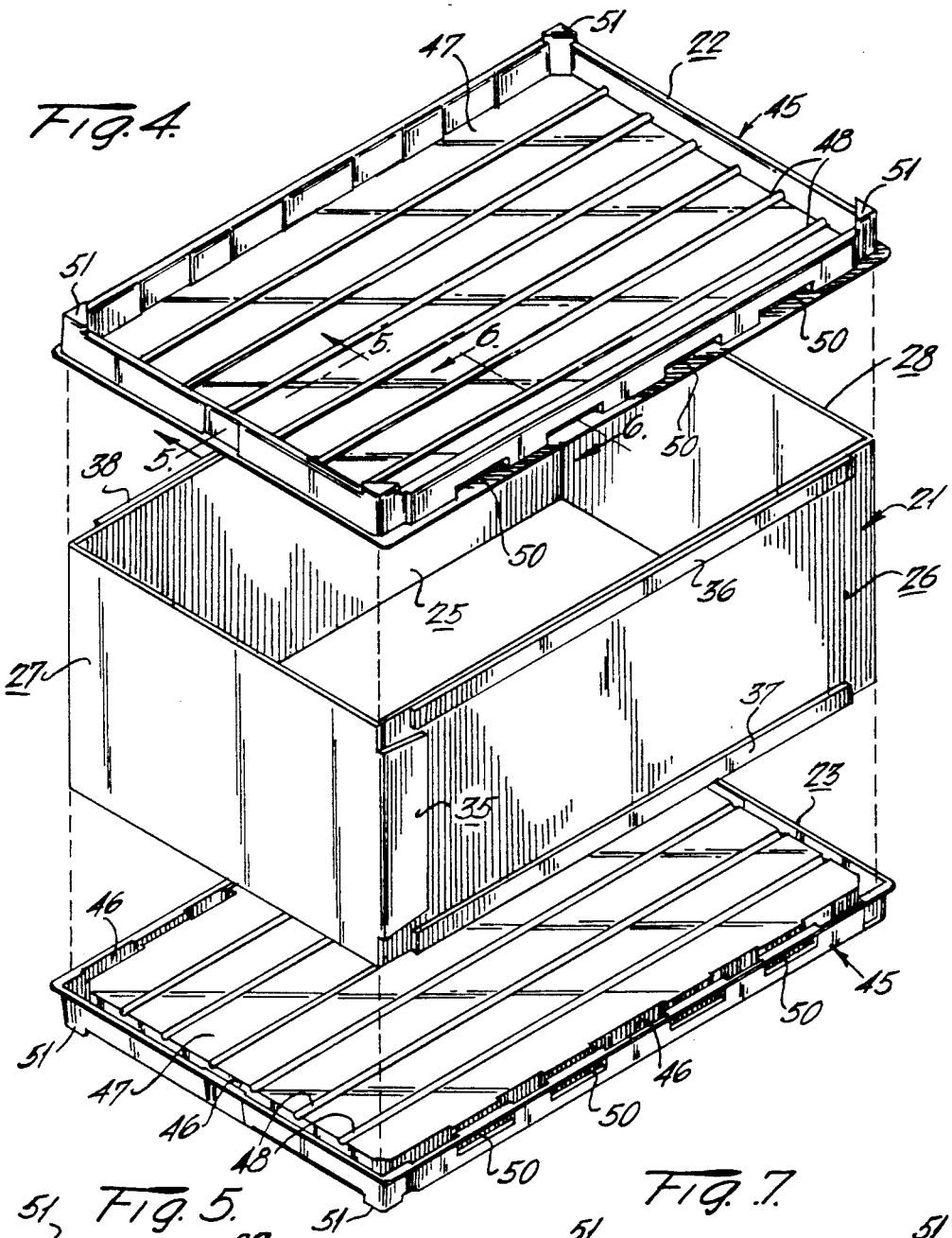
FIG. 4 is an exploded isometric view illustrating the component parts of the shipping box shown in FIG. 1, showing details of the cardboard sidewall construction and details of both the inner and outer faces of the plastic closure member.
Figure 5:
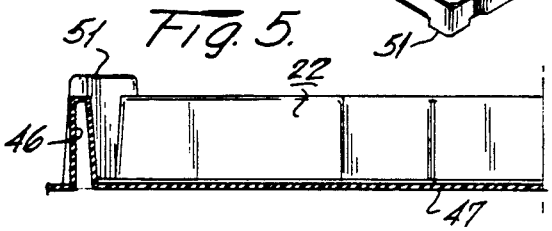
FIG. 5 is an enlarged fragmentary sectional elevational view taken on the line 5,5 of FIG. 4.

The blank for body 21 as seen in FIG. 8 is formed of one flat piece, with fold lines for the corners at 30, 31, 32 and 33. Body 21 has additionally a fold-over tab 35 which is glued to end of side 26 of the folded body, as seen particularly in FIGS. 2, 4 and 10. FIG. 9 shows the blank of FIG. 8 being folded with tab 35 about to be secured to side 26. Thus, the sides and ends are formed into a continuous hollow structure which can be folded flat as seen in FIG. 10, for shipment from the factory and storage, and then unfolded into a hollow rectangular shape for erection into the finished box, as seen in FIG. 4.

Box body 21 has lips 36,37 and 38,40 at the top and bottom of sides 25 and 26. The lips are formed by slitting one wall 41 of the corrugated board and then forming a fold line 42 as seen in FIG. 11. The lips are then folded over as seen at arrow 43 in FIG. 9.

The function of the lips 36,37 and 38,40, is to secure top 22 and bottom 23 as will be described in detail. Lips may additionally be formed on the ends of the box body 21.

Top 22 and bottom 23 are identical and are in the form of lids 45 which snap on the box body.

Figure 3:
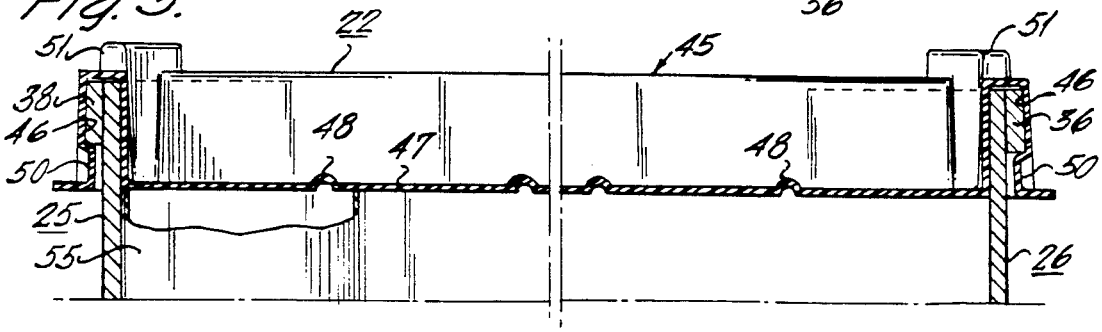
FIG. 3 is an enlarged fragmentary sectional elevational view taken on the line 3,3 of FIG. 2. A portion of continuous detail has been broken out centrally of the box as designated by the dot-and-dash break lines. The view details the means by which the plastic cover plate is held captive to the cardboard sidewalls and other details of construction of both the plastic cover plate and cardboard sidewalls.
Figure 6:
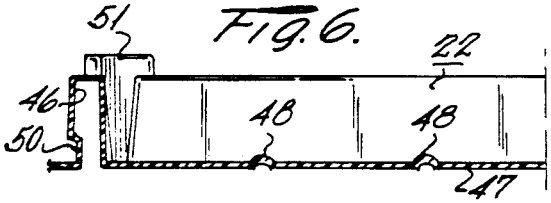
FIG. 6 is an enlarged fragmentary sectional elevational view taken on the line 6,6 of FIG. 4.

Lid 45 is molded desirably of a stiff, transparent plastic. A receiving groove 46 extends entirely around the perimeter of an integral web 47 having reinforcing corrugation 48 longitudinally spaced therein. Receiving groove 46 is U-shaped in cross section and has spaced therein snaps 50 as seen in cross section in FIGS. 3 and 6, which are snapped into place over lips 36,37 and 38,40. This is done by positioning the top 22 and bottom 23 as seen in FIG. 4, and the sliding receiving groove 46 over the sides and ends of body 21 until snaps 50 engage lips 36,37 and 38,40, thereby molding the top and bottom securely in place. The engagement of the snaps and the lips is particularly shown in FIG. 3.

Figure 7:
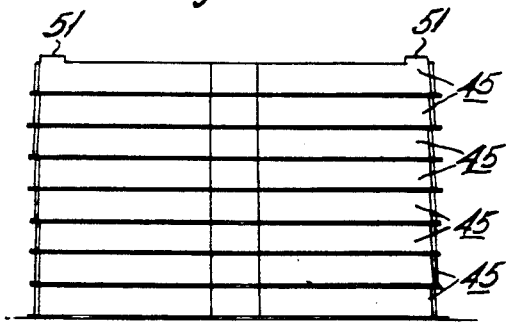
FIG. 7 is a small scale schematic view illustrating the tacking feature of the plastic closure member.

The molded lids 45 can nest as seen in FIG. 7, thereby saving shipping and storage space prior to erecting the box 21. The lid 45 has corner posts 51 molded into the corners to aid in stacking and nesting.

Figure 2:
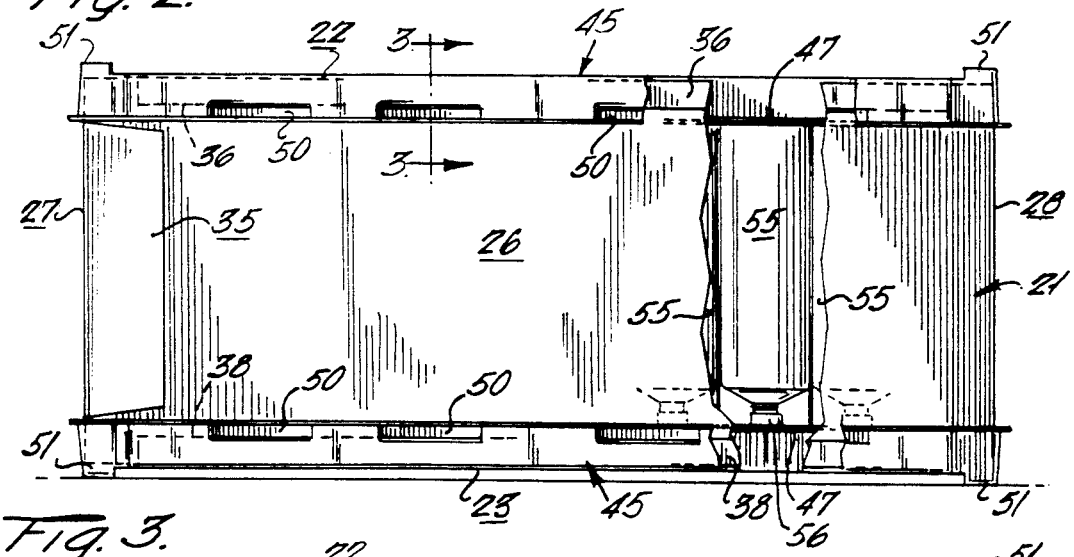
FIG. 2 is a side elevational view of the box shown in FIG. 1, with a portion broken away and in section, showing certain features of construction and a partial view of the box contents which comprise fragile metallic collapsible tubes.

When the box 20 is used for shipping empty collapsible tubes 55 as seen in FIG. 2, the tubes are inverted for packing so that the cap 56 of the tube rests on the bottom 23, and the open, circular-shaped bottom of the tube rests snugly against web 47. The tubes are positioned in column fashion adjacent one another, so that in effect a honeycombed structural element exists within the box, creating a strong resistance against any box deformation which would damage the fragile collapsible tubes.

The box construction as described above is such that the box body 21, in folded form, is flat and can be piled on top of another in shipment and storage. The tops 22 and bottoms 23 can be nested to save space, as seen in FIG. 7.

In use, a folded box body 21 as seen in FIG. 10, is opened up to the condition seen in FIG. 4 by simply spreading sides 25 and 26 apart. A bottom 23 is then snapped over sides 25 and 26, and ends 27 and 28 until snaps 50 engage lips 36,37 and 38,40 as seen particularly in FIG. 3. It should be understood that in assembling the box, it will probably be easier, in forming the bottom, to simply snap a lid 45 on top of a box body 21 initially, and then simply invert the box.

The empty collapsible tubes 55 are then positioned vertically within the box, either by hand or by machine, and then lid 45 snapped on top to form box top 22. The box 21 is thus fully assembled, packed, and closed, for shipping and storage.

When unpacking, the receiving groove 46 is simply flared outwardly by hand so that snaps 50 disengage from lip 40, and the top 22 is lifted off. The plastic of top 22 is of a somewhat flexible construction, to permit such flaring or bending.

The box, after being emptied, can be further disassembled by removing the bottom 23 in the same manner as the top, with the lids 45 being again stacked in nested fashion as seen in FIG. 7 and the sides collapsed as seen in FIG. 10, for shipment back to the tube manufacturer for sterilization, for instance in a gas chamber, if desired, and reuse.

I claim:

1. A box for shipping and storing empty collapsible tubes positioned vertically within the box, wherein the tubes in a box fully loaded form a honeycombed column effect that gives structural strength to the assembled box and prevents damage to the tubes, comprising A) a box body in the form of a hollow rectangle with an open top and bottom and having
  1) opposed sides and ends that are alternately continuous,
  2) a folded lip extending along the box body at the top and bottom, and B) a pair of lids that form a top and bottom of the box, each lid having
  1) a flat web, conforming generally in size and shape to the length and width of the box body and having a perimeter,
  2) a receiving groove generally U-shaped in cross section extending around the perimeter of the web, and
  3) snaps formed within the receiving groove;

wherein
  1) the sides and ends of the box body at top and bottom lie partially within the receiving groove of the lid, and
  2) the snaps within the groove engage the box body lip.

2. A box of claim 1 wherein the box lid at the top and bottom exert vertical pressure on the vertically extending empty collapsible tubes, whereby the tubes are kept immobile within the box.

3. The box of claim 1 wherein the lids are formed of a molded plastic.

4. The box of claim 2 wherein the lids have corner posts molded integrally therein to aid in stacking and nesting the lids, when not assembled to the box body.

5. The box of claim 1 wherein the lids are removed from the box body by distorting the receiving groove to release the snaps from the lips.

6. In a box capable of being assembled and disassembled for storage, shipment and reuse, and having A) a box body in the form of a hollow rectangle with an open top and bottom and having
  1) opposed sides and ends that are alternately continuous,
  2) a folded lip extending along the box body at the top and bottom, and B) a pair of lids that form a top and bottom of the box, each lid having
  1) a flat web, conforming generally in size and shape to the length and width of the box body and having a perimeter,
  2) a receiving groove generally U-shaped in cross section, and having a height above the web, extending around the perimeter of the web, and
  3) snaps formed within the receiving groove;

wherein
  1) the sides and ends of the box body at top and bottom lie partially within the receiving groove of the lid, and
  2) the snaps within the groove engage the box body lip;

the improvement comprising
  1) a taper in the cross section of the receiving groove, and
  2) corner posts integral with the lid, having a height in excess of the height of the receiving groove;

whereby the lids can nest with the tapered U-shaped receiving grooves fitting one with another in spaced relationship, the lids being held in such spaced relationship by the corner posts.

* * * * *